US007726230B1

(12) United States Patent
Erdem

(10) Patent No.: US 7,726,230 B1
(45) Date of Patent: Jun. 1, 2010

(54) SEMIAUTOMATIC PISTOL

(76) Inventor: Saim Alper Erdem, Gelik Sokak No: 22, Ferahevier/Tarabya, Istanbul (TR)

( * ) Notice: Subject to any disclaimer, the term of this patent is extended or adjusted under 35 U.S.C. 154(b) by 365 days.

(21) Appl. No.: 12/007,210

(22) Filed: Jan. 8, 2008

(51) Int. Cl.
*F41A 3/04* (2006.01)

(52) U.S. Cl. ..... 89/184; 89/185; 42/69.02

(58) Field of Classification Search ..... 89/194, 89/195, 196, 186, 128, 132, 141, 158, 180, 89/185, 184; 42/69.02
See application file for complete search history.

(56) References Cited

U.S. PATENT DOCUMENTS

| | | | | | |
|---|---|---|---|---|---|
| 786,099 | A | * | 3/1905 | Clement et al. | 89/144 |
| 965,661 | A | | 7/1910 | Schrader | |
| 1,017,119 | A | | 2/1912 | Toborg | |
| 1,039,232 | A | * | 9/1912 | Wesson | 89/195 |
| 1,187,888 | A | * | 6/1916 | Diehm | 89/144 |
| 1,226,478 | A | * | 5/1917 | Diehm | 89/144 |
| 1,359,365 | A | * | 11/1920 | Hammond | 89/138 |
| 1,403,133 | A | * | 1/1922 | Stokke | 89/145 |
| 1,407,959 | A | | 2/1922 | Stokke | |
| 1,460,672 | A | | 7/1923 | Hines | |
| 1,911,494 | A | * | 5/1933 | Floyd | 89/137 |
| 2,248,445 | A | * | 7/1941 | Wilson | 89/199 |
| 3,207,037 | A | | 9/1965 | Pachmayr et al. | |
| 3,276,323 | A | * | 10/1966 | Dieckmann | 89/195 |
| RE26,872 | E | * | 4/1970 | Dieckmann | 89/195 |
| 3,997,994 | A | | 12/1976 | Kastner et al. | |
| 4,003,292 | A | | 1/1977 | Christakos | |
| 4,127,056 | A | * | 11/1978 | Kart | 89/128 |
| 4,152,857 | A | | 5/1979 | Ketterer | |
| 4,348,941 | A | | 9/1982 | Ketterer et al. | |
| 4,542,606 | A | * | 9/1985 | Hoenig | 42/75.02 |
| 5,320,023 | A | | 6/1994 | Erdem | |
| 5,939,657 | A | | 8/1999 | Morgado | |
| 6,439,217 | B1 | * | 8/2002 | Shih | 124/77 |
| 7,201,094 | B2 | * | 4/2007 | Jebsen et al. | 89/189 |
| 2007/0012170 | A1 | | 1/2007 | Spielberger | |
| 2008/0155874 | A1 | * | 7/2008 | Jebsen et al. | 42/1.06 |

FOREIGN PATENT DOCUMENTS

| | | |
|---|---|---|
| GB | 14023 | 6/1906 |

* cited by examiner

*Primary Examiner*—Benjamin P Lee
(74) *Attorney, Agent, or Firm*—Richard C. Litman

(57) ABSTRACT

The semiautomatic pistol has a rigidly fixed barrel and sights attached thereto. The body of the pistol receives a breechbolt that moves axially in line with the fixed barrel. Cartridges are transferred from the magazine up to the action in the breechbolt, and spent cartridge cases are ejected out of a side eject port disposed on the pistol. Dismounting of the breechbolt is facilitated by a pivotal dismounting post at the rear of the eject port.

4 Claims, 8 Drawing Sheets

SEMIAUTOMATIC PISTOL

BACKGROUND OF THE INVENTION

1. Field of the Invention

The present invention relates to firearms, and more particularly to a semiautomatic pistol having a breechbolt slidable and rotatable on the receiver.

2. Description of the Related Art

The design of the semiautomatic pistol has not changed significantly since the introduction of the Colt .45 Model 1911 in the early 1900s. Since that time, others have made some minor modifications in the basic design, but nothing of a fundamental nature.

In the Model 1911 pistol, cartridges are stored in an ammunition clip, which is inserted into the grip of the pistol. Cocking and firing of the gun are accompanied by movement of an external slide, and spent shells are ejected from the top of the gun, where they can be distracting to the shooter. The slide travels a distance on the order of two inches each time the gun is fired, and this limits the cycle time or rate at which successive rounds can be fired. Sights are mounted on the moving slide, which makes aiming difficult, and the sliding mechanism and other parts of the action are subject to substantial wear and mechanical failure.

In case of the gun being of a target type, it is nearly impossible to get a secure aim with recoiling sights. Therefore sights should be mounted on places free from recoiling, shaking and locations subject to substantial wear and mechanical failure. On a gun with a reciprocating slide, the sights should be at a most forward location and a most rearward location of the gun on safe and secure places. Given the aforementioned, there would only be one way to mount the breechblock, i.e., from the sides, since front and rear portions are closed.

Thus, a semiautomatic pistol solving the aforementioned problems is desired.

SUMMARY OF THE INVENTION

The semiautomatic pistol has a rigidly fixed barrel and sights attached thereto. The body of the pistol is receives a breechbolt that moves axially in line with the fixed barrel and then rotatably with respect to the fixed barrel axis. Cartridges are transferred from the magazine up to the action in the breechbolt, and spent cartridge cases are ejected out of the eject port. Sights are attached to front and rear sections of the fixed barrel.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
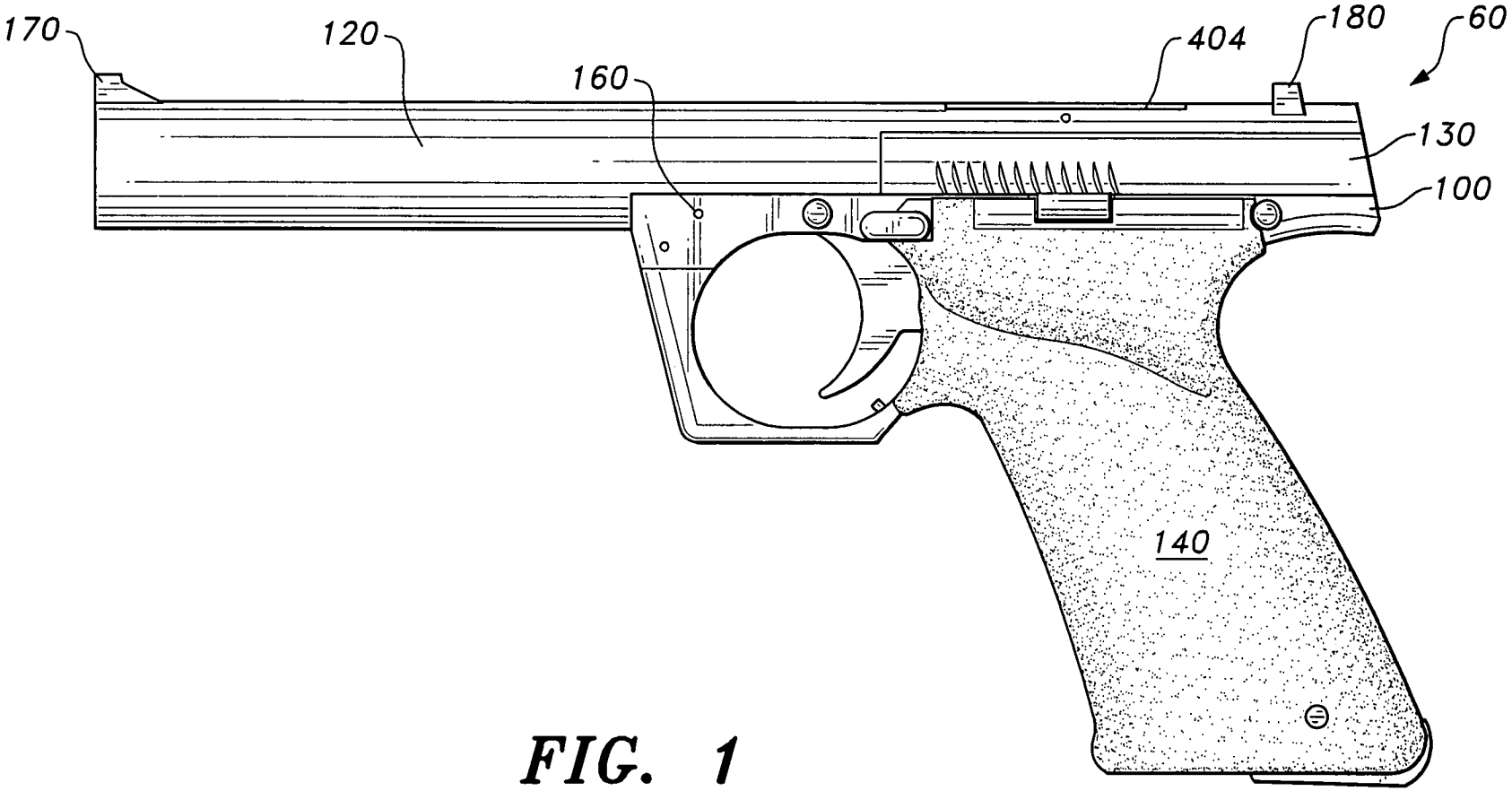
FIG. 1 side view of the semiautomatic pistol according to the present invention.
Figure 2:
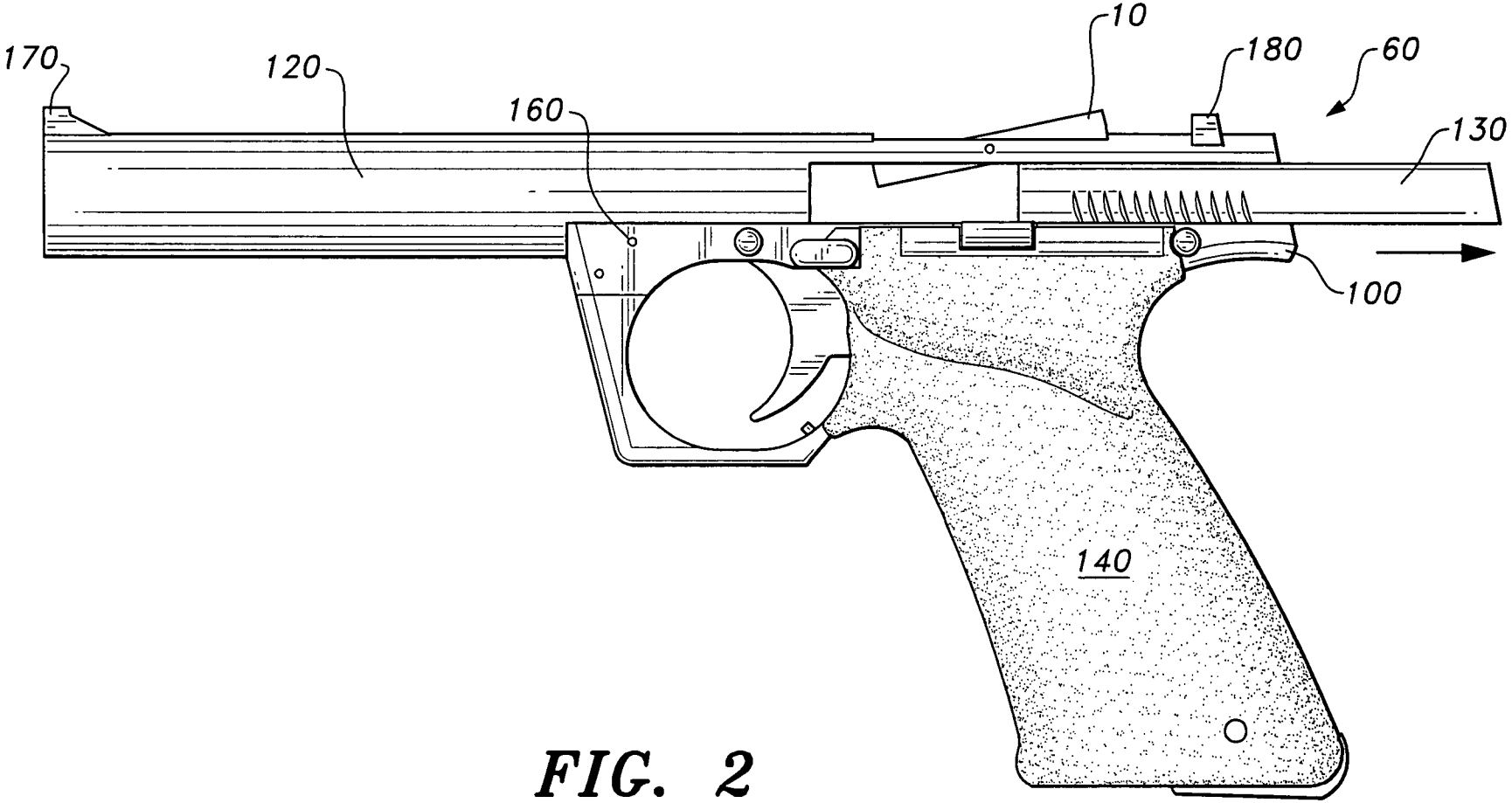
FIG. 2 is a side view of the semiautomatic pistol according to the present invention, showing slider action according to the present invention.
Figure 3:
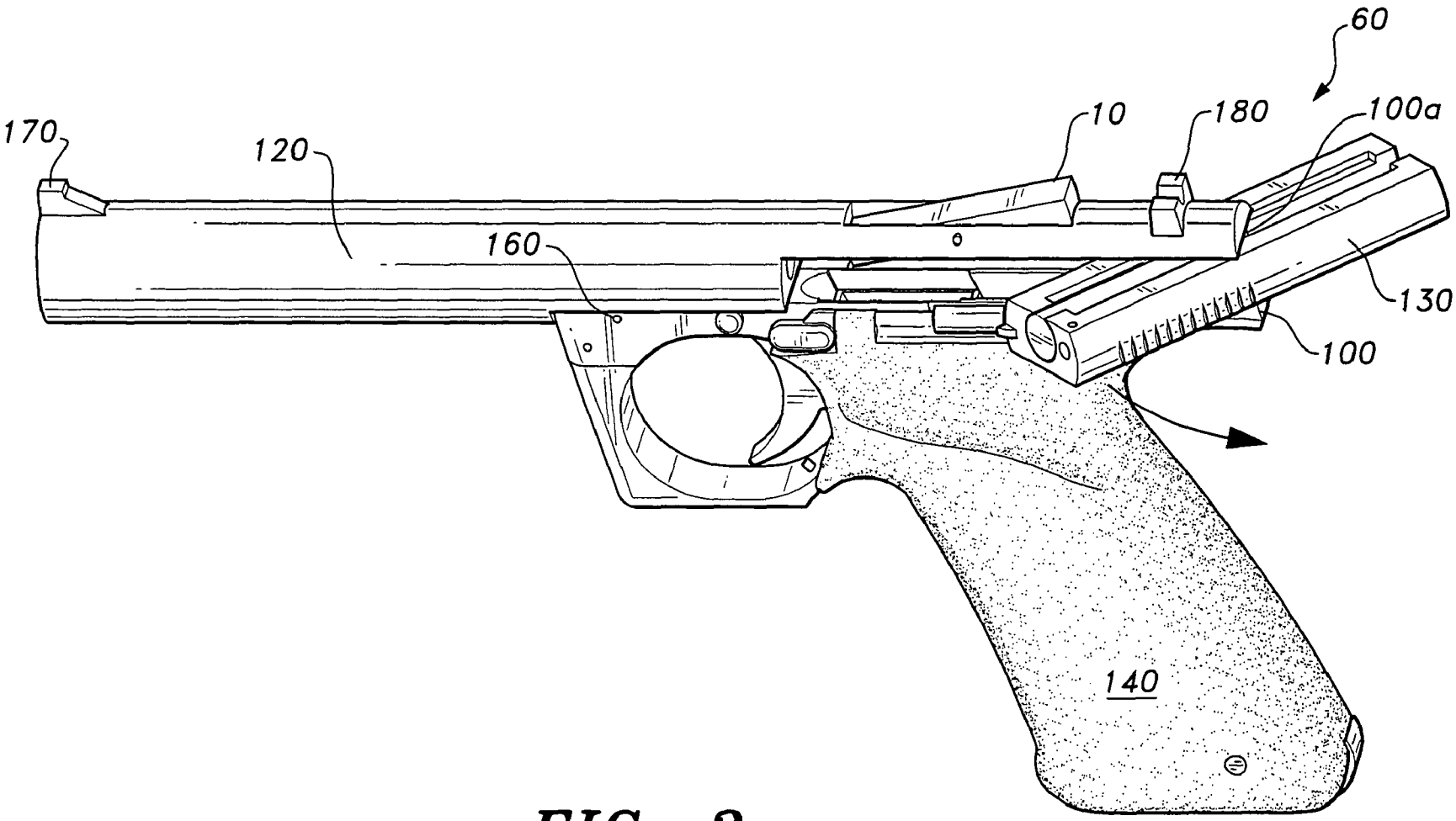
FIG. 3 is a perspective view of the semiautomatic pistol according to the present invention, showing the breechbolt rotated.
Figure 4A:
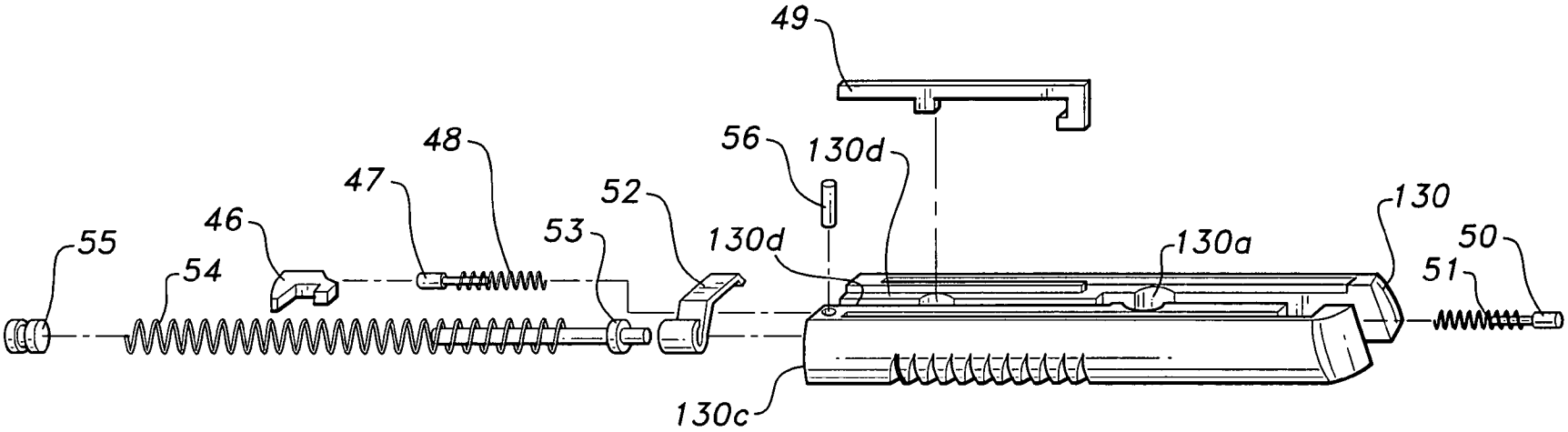
FIGS. 4A and 4B show exploded perspective views of subassemblies of the semiautomatic pistol according to the present invention.
Figure 4B:
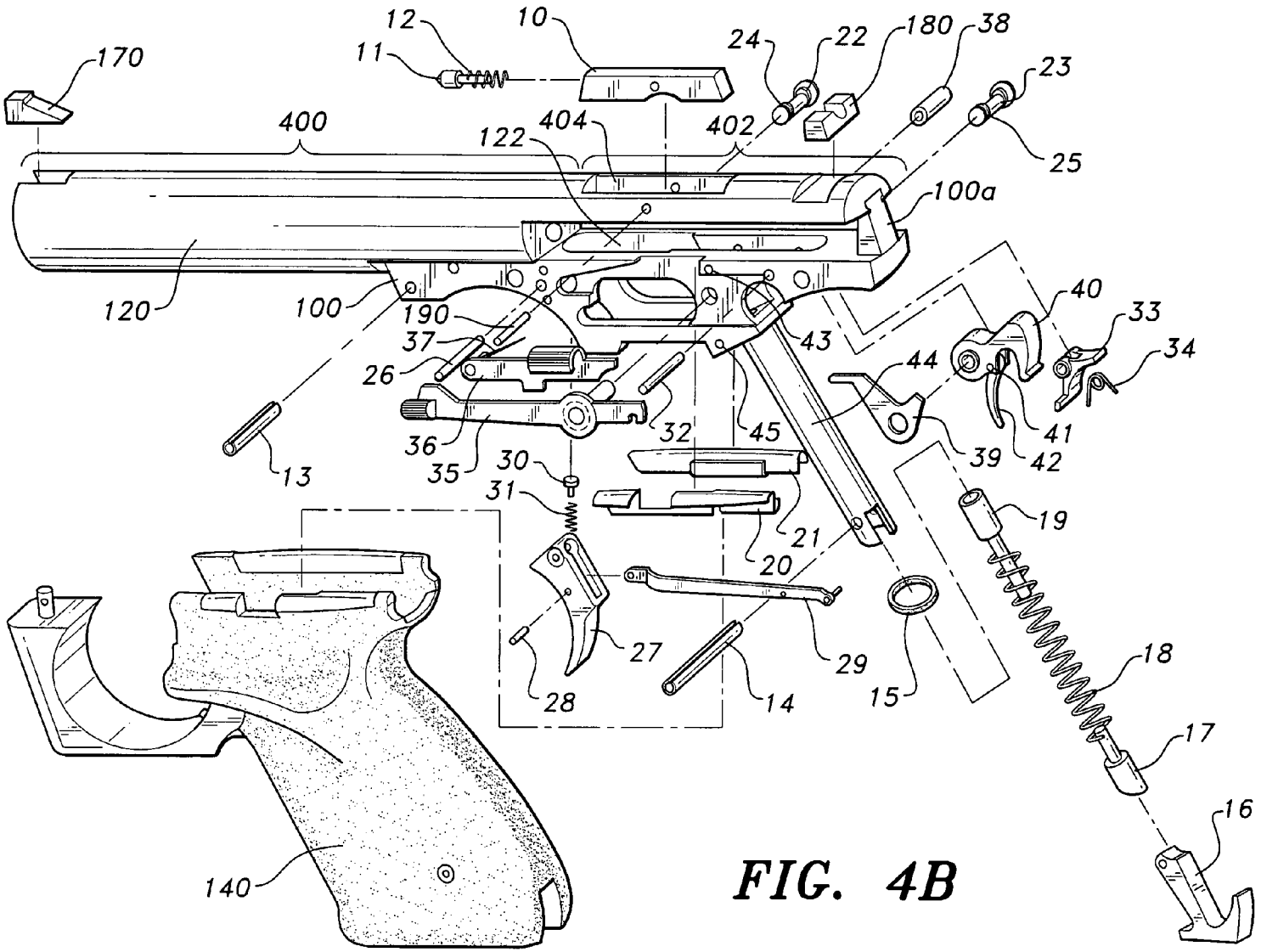

As shown in FIGS. 1-4B, the present invention relates to a semiautomatic pistol 60, including a barrel 120 having a hollow tubular front portion 400 and a rear portion formed by a top wall 402 that extends away from the front portion 400 of the barrel 120. A barrel retainer pin 160 is used to attach a rigid receiver 100 to the barrel 120 to form a longitudinally extending eject port 122. A breechbolt slide post 100*a* extends downward from the barrel rear portion top wall 402 into the receiver 100 at the rear of the eject port 122.

A breechbolt 130 being slidably and rotatably mounted around the breechbolt slide post 100*a* is mounted within the receiver 100 and top wall 402. The breechbolt 130 includes a front face having a recess 130*c* receiving the forward end of a recoil spring guide 53, with the rear end of the recoil spring guide 53 received within a recoil spring compressor 52 fixedly mounted to rear distal end of the receiver 100 to bias the breechbolt 130 in a forward orientation.

A recoil spring 54 may be wound about the guide 53 and captured between the front face 130*c* of breechbolt 120 and the compressor 52 by retaining an axially engaged recoil spring plug 55 with a recoil spring plug retaining pin 56 that slidably mounts into a vertical bore in breechbolt 130. Internal walls of the breechbolt side arms 130*b* form an opening capable of receiving a firing pin plunger 50 and firing pin spring 51 therethrough, the firing pin plunger 50 being in an axially sliding relationship relative to the breechbolt 130.

Between the front and rear of breechbolt 130 are indentations in the breechbolt side arm interior walls that form a turn recess 130*a*. Turn recess 130*a* functions as a pivot point for axial rotation of the breechbolt 130. Firing pin 49 is movably disposed inside front portion of the breechbolt 130 for operable communication with the firing pin plunger 50.

An extractor 46 is biased forwardly by an extractor plunger 47 that captures an extractor spring 48 between the extractor plunger 47 and a forward end of the breechbolt face for operable communication of a cartridge head directed into a bore of barrel 120.

A top wall lever aperture 404 is disposed in the top wall 402. Lever 10 is disposed inside the top wall lever aperture 404, the lever being pivotally attached to the top wall 402 by lever axis pin 190. The lever 10 is biased by a lever plunger 11 in combination with a lever plunger spring 12. Adjusting pin 22 in combination with adjusting pin retainer ring 24 is in operable communication with lever 10 in order to adjust pivotal travel distance of the lever 10. The breechbolt 130 preferably has at least one longitudinally disposed groove 130*d* that the lever 10 can slidably engage to guide reciprocal motion of the breechbolt 130 during firing of the gun 60.

A hammer 40 capable of engaging firing pin plunger 50 is pivotally mounted in the receiver 100 about a hammer axis pin 38 and is disposed in a position for engagement with sear 33 in a cocked orientation of the hammer 40. Ejector 39 is coaxially mounted with the hammer 40. Adjusting pin 23 in combination with adjusting pin retainer ring 25 is in operable communication with the hammer assembly in order to limit cocking travel of hammer 40. A hammer strut 42 is pivotally disposed on the hammer 40 and is retained by hammer strut axis pin 41. A hammer stop pin 43 is disposed through the receiver to arrest forward pivotal motion of the hammer 40 during firing action. Sear 33 is pivotally mounted in the receiver 100 and retained by sear axis pin 32 while being biased by coaxially mounted sear spring 34. A main spring 18 is wound about a hammer plunger 19 at an upper end of the main spring 33 and wound about a magazine latch plunger 17 at a lower end of the main spring 33. A magazine latch 16 is configured to abut against the free end of magazine latch plunger 17 to retain a magazine when the pistol 60 is fully assembled. A hollow main spring housing 44 is attached to the receiver 100 by a main spring housing retaining pin 45 and may extend downward from the receiver 100 at an angle. The main spring 18, hammer plunger 19 and magazine latch plunger 17 are disposed through a mainspring washer 15 and inside the hollow main spring housing 44. When handle 140 is attached to receiver 100 a lower handle retainer pin 14 being disposed through the handle 140 and the main spring housing 44 retains handle 140 and magazine latch 16 in operable position.

Receptacles 20 and 21 are disposed on the receiver 100 and slidingly engage top of handle 140 for a secure friction fit attachment to the receiver 100. The handle 140 houses a trigger 27 pivotally about a trigger axis pin 26, the trigger axis pin 26 being disposed in the receiver 100. The trigger includes a trigger spring 31 having a trigger spring plunger 30 at its forward end mounted between the trigger and the receiver 100 in order to bias the trigger 27 downwardly in communication with a forward end of a trigger bar 29. Forward end of trigger bar 29 is pivotally retained in the trigger 27 by trigger bar axis pin 28. The trigger bar 29 extends rearward of the trigger 27 inside handle 140. Extreme rear of trigger bar 29 has a boss that engages the sear 33 to displace the sear 33 relative to the hammer 40 permitting the hammer 40 to engage the firing pin plunger 50 directing the firing pin 49 forwardly into engagement with a cartridge (not shown) positioned within a bore of barrel 120.

An elongate safety latch 35 is pivotally disposed in the receiver 100 to engage the trigger 27 in a safety position that prevents firing of the pistol 60. A breechbolt stop 36 having a breechbolt stop spring 37 is attached to the receiver 100 in a position for operable communication with the breechbolt 130 to limit travel of the breechbolt 130.

The handle 140 is further secured to the receiver by upper handle retainer pin 13 and can receive an automatic pistol magazine of a type known in the art.

A rear sight 180, as well as a front sight 170, are aligned and mounted to respective rear and front portions of barrel 120 respectively. Advantageously, when firing the gun 60 neither the rear sight 180 nor the front sight 170 moves with respect to the barrel 120 or receiver 100.

Figure 5:
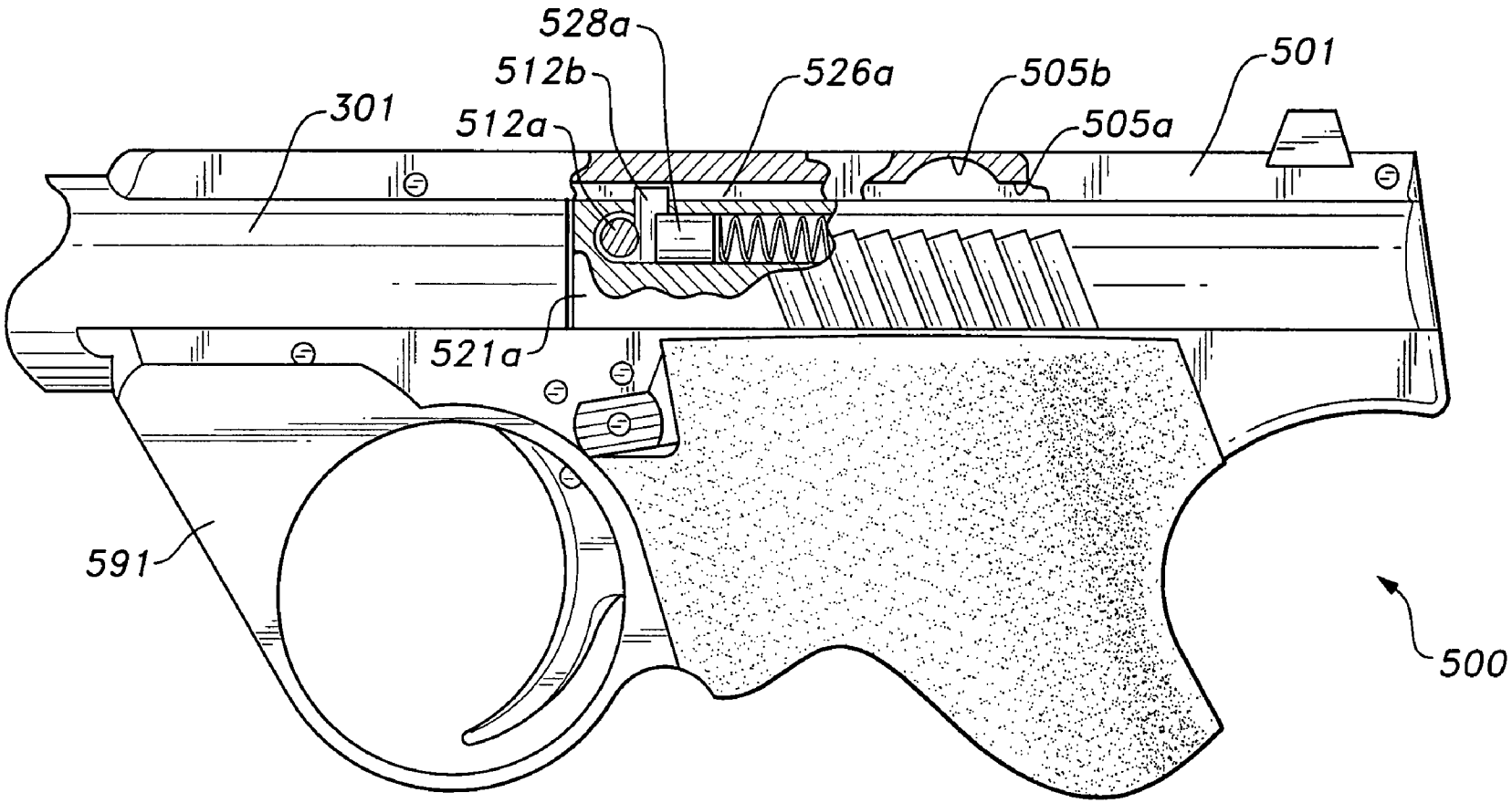
FIG. 5 is a partial side view of the semiautomatic pistol according to the present invention, broken away and partially in section to show details thereof.
Figure 6:
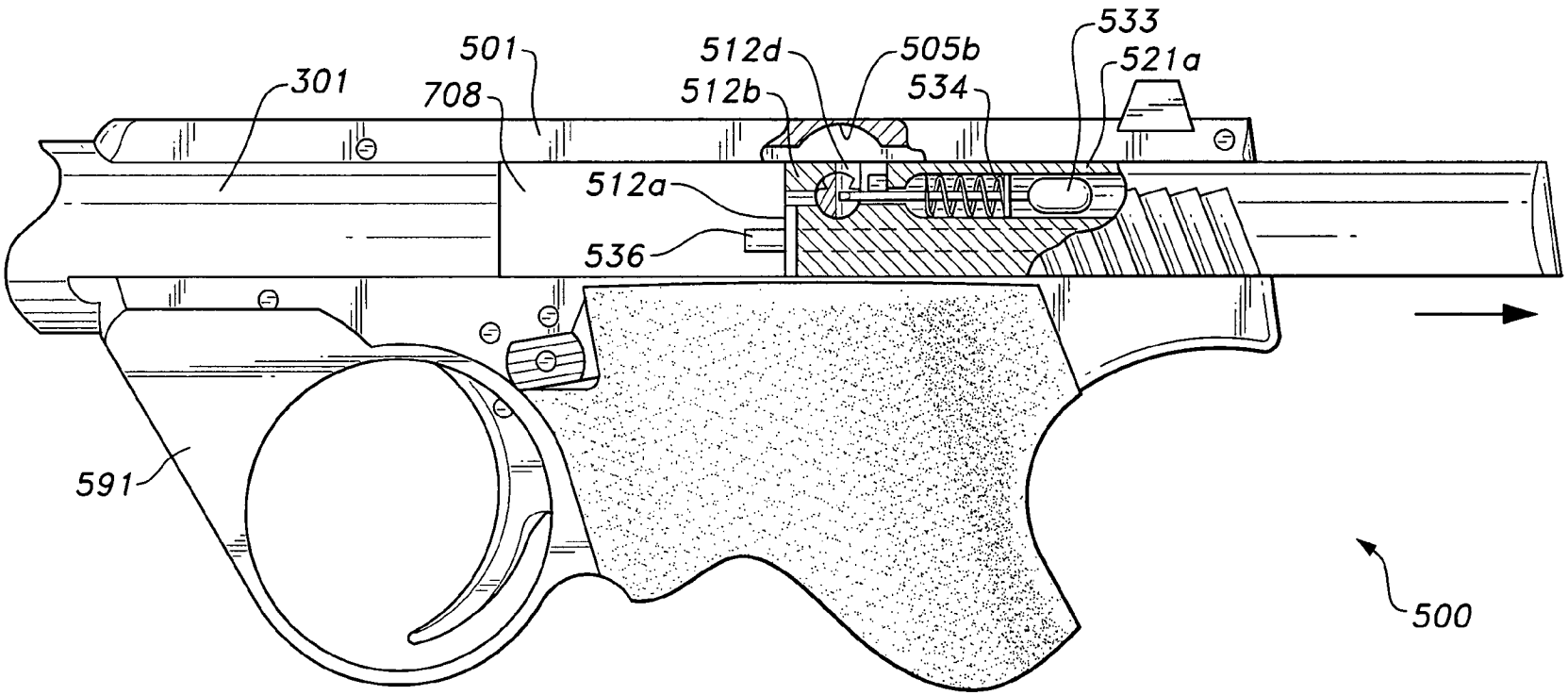
FIG. 6 is a partial side view of the semiautomatic pistol according to the present invention, broken away and partially in section with the breechbolt drawn.
Figure 7:
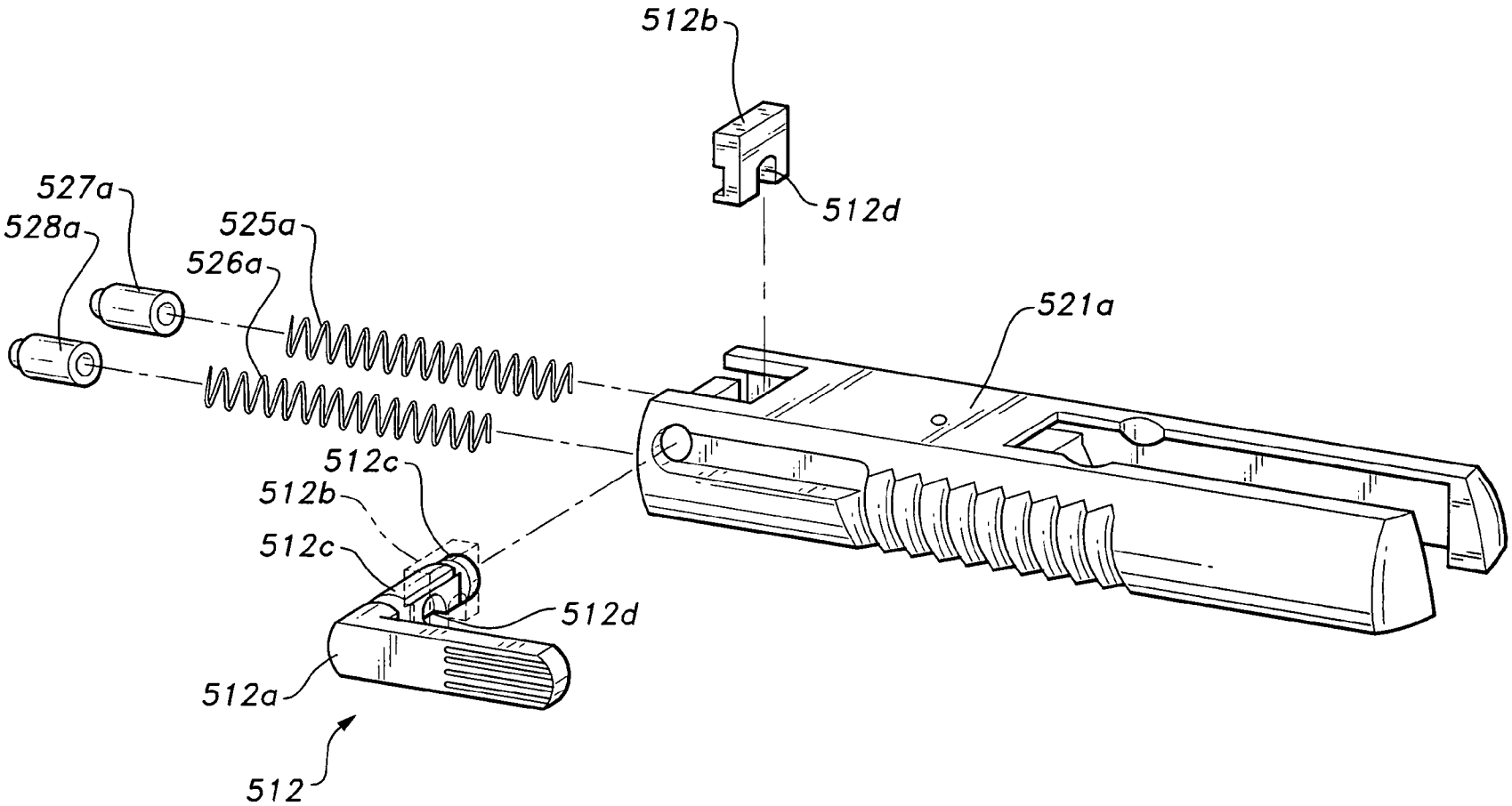
FIG. 7 is a perspective view of the breechbolt of a semiautomatic pistol according to the present invention having alternative retainer elements.

As shown in FIGS. 5-7 an alternatively configured breechbolt 521 may be used. A top strap 501 is attached to and extends rearward away from barrel 301. The top strap 501 has a breechbolt retainer guiding groove 505*a* and a breechbolt retainer lock rotating recess 505*b*. Top strap 501 and receiver 591 attach to form a bottom and top enclosure having an open sided eject port 708. A breechbolt retaining assembly 512 is mounted in the breechbolt for slidable engagement with receiver 591 and comprises L shaped breechbolt retainer body 512*a* having breechbolt retainer detent grooves 512*c*. A breechbolt lock 512*b* has a lateral slot that engages the retainer lever 512. A breechbolt retainer firing pin crosscut 512*d* is disposed in the breechbolt retainer lock 512*b*. Recoil spring plugs 527*a* and 528*a* are held by retainer lever 512. Recoil springs 525*a* and 526*a* are wound around recoil spring plugs 527*a* and 528*a* respectively. The entire recoil assembly is disposed within the breechbolt 521 with the recoil springs 525*a* and 526*a* having one end fixedly attached to a rear portion of the receiver 591 to provide spring bias to the breechbolt 521. The breechbolt 521 is slidably engaged between the top strap 501 and the receiver 591. Interior portion of breechbolt 521 has a solid lateral piece 521*a* joining the sidewalls. The breechbolt retaining detent grooves 512*c* of the retaining assembly 512 being attached to the breechbolt 521 allow the breechbolt 521 to slidably engage a correspondingly grooved receiver 591. Sidewalls of breechbolt 521 have indentations that form a turn recess 530*a* for pivotal movement of the breechbolt 521 during firing action. Axially extending slidable firing pin 533 is disposed within the breechblock 521 and biased by firing pin spring 534. Extractor 536 is pivotally disposed within the breachbolt 521 to provide extraction of spent cartridges through the eject port 708.

It is to be understood that the present invention is not limited to the embodiment described above, but encompasses any and all embodiments within the scope of the following claims.

I claim:

1. A semiautomatic pistol, comprising:

a barrel having a front portion and a rear portion, the barrel having a top wall extending distally from the front portion of the barrel, forming the rear portion of the barrel;

a receiver immovably attached to the barrel and forming a longitudinally extending eject port below the top wall of the barrel, the eject port having a rear;

a breechbolt slide post extending downward from the top wall into the receiver at the rear of the eject port;

a breechbolt having a rear and side arms extending longitudinally to the rear of the breechbolt, the side arms having interior walls defining indentations forming a rotational pivot axis of the breechbolt, said indentations movable from a forward position apart from said slidepost to a rearward position substantially aligned with said slidepost;

the interior walls extending longitudinally to form a channel extending from the pivot axis to the rear of the breechbolt, the breechbolt channel slidably engaging the slide post;

the breechbolt rotatable about the slide post when the indentations are in the rearward position;

a first sight attached to the front portion of the barrel;

a second sight attached to the rear portion of the barrel;

a grip handle attached to the receiver;

means for carrying a plurality of rounds in the pistol; and means for semiautomatically firing the rounds;

wherein the barrel and the sights remain in a fixed position relative to the receiver during the firing of the rounds as the breechbolt reciprocally slides about the post.

2. The semiautomatic pistol according to claim 1, wherein the breechbolt has a longitudinal groove defined therein, the breechbolt slidably engaging the groove for reciprocal motion of the breechbolt.

3. The semiautomatic pistol according to claim 1, wherein the top wall of the barrel has an aperture defined therein and the breechbolt has a longitudinally extending groove defined therein, the semiautomatic pistol further comprising a spring-biased lever disposed within the top wall aperture, the lever engaging the breechbolt groove to guide reciprocal motion of the breechbolt during firing of the pistol.

4. The semiautomatic pistol according to claim 1, wherein the means for semiautomatically firing the rounds further comprises:

means for striking the cartridge;

a trigger pivotally mounted in the receiver;

a hammer pivotally mounted in the receiver;

a trigger bar pivotally mounted on the trigger, the trigger bar extending rearward and having a sear engagement boss on its end; and a sear, the sear engagement boss engaging the sear to displace the sear relative to the hammer to engage the means for striking the cartridge.

* * * * *